United States Patent [19]

Pyzer

[11] Patent Number: 4,683,927

[45] Date of Patent: Aug. 4, 1898

[54] TOY BOX WITH REMOVABLE COVERING

[76] Inventor: Joan B. Pyzer, 16389 E. Rutherland, Southfield, Mich. 48076

[21] Appl. No.: 260,458

[22] Filed: May 4, 1981

[51] Int. Cl.[4] ..... B65D 1/22; B65D 1/40; B65D 25/34; B65D 51/00

[52] U.S. Cl. ..... 150/52 R; 150/48; 220/400; 220/461; 220/902; 383/109; 383/111; 383/113

[58] Field of Search ..... 150/48, 49, 50, 52 R, 150/2.1, 2.7; 206/594; 220/400, 444, 461, 902; 190/42; 383/42, 78, 81, 105, 109, 110, 111, 113, 902

[56] References Cited

U.S. PATENT DOCUMENTS

| | | | |
|---|---|---|---|
| 2,575,191 | 11/1951 | Seipp | 150/52 R X |
| 2,954,891 | 10/1960 | Imber | 150/52 R X |
| 3,106,313 | 10/1963 | Kurhan | 220/400 X |
| 3,189,074 | 6/1965 | Schaefer | 150/52 R |
| 3,202,998 | 8/1965 | Hoffman | 220/902 X |
| 3,416,692 | 12/1968 | Cline et al. | 220/902 X |
| 4,143,695 | 3/1979 | Hoehn | 150/52 R |

FOREIGN PATENT DOCUMENTS

| | | | |
|---|---|---|---|
| 1451642 | 9/1966 | France | 150/2.1 |
| 2041332 | 9/1980 | United Kingdom | 150/52 R |

*Primary Examiner*—William Price
*Assistant Examiner*—Sue A. Weaver
*Attorney, Agent, or Firm*—Krass & Young

[57] ABSTRACT

A child-safe toy box includes a container and lid assembly structurally defined by self-supporting, readily flexible foam having a form fitting cover thereon which protectively encloses the foam. The cover may be of woven cloth and includes an inner portion permanently disposed over the foam and an outer decorative portion. The outer portion of the cover is provided with snap-open seams to allow removal thereof from the container and lid for cleaning purposes. A cloth hinge connects the lid with the container. An optional flexible, plastic liner may be inserted within the container to provide added rigidity and protect the foam against piercing by sharp toys.

15 Claims, 9 Drawing Figures

Fig-3
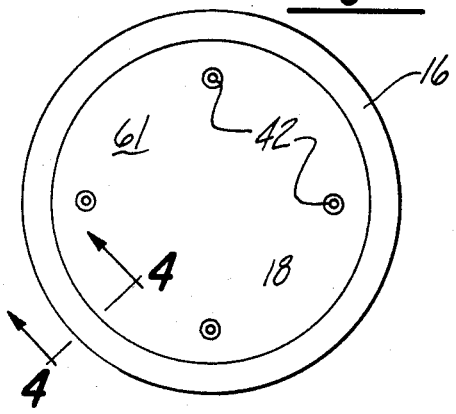
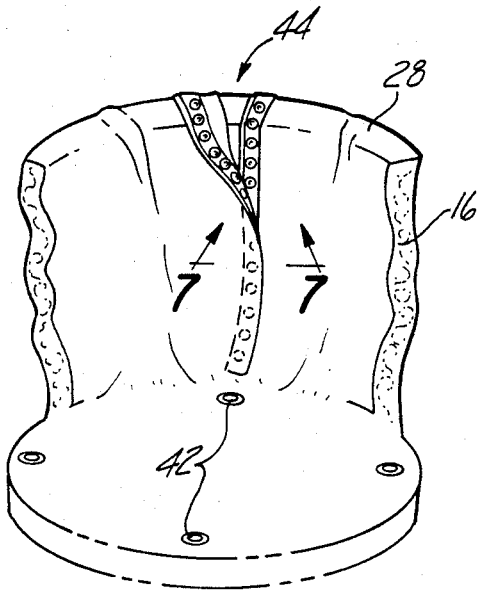
Fig-6
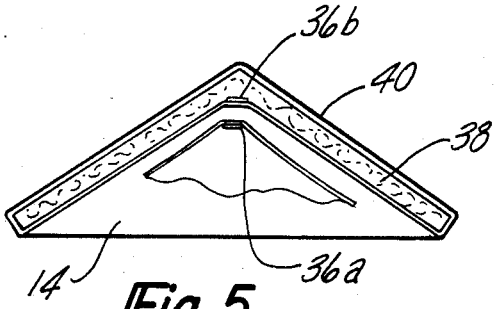
Fig-5
Fig-8
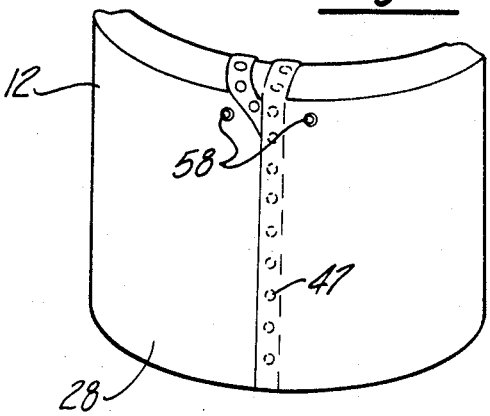
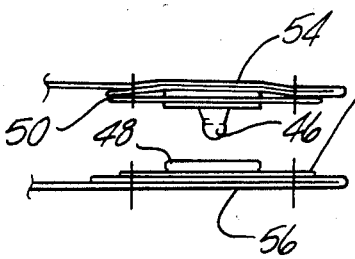
Fig-7
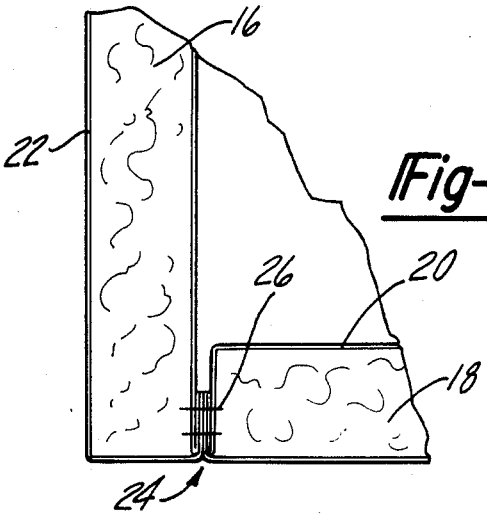
Fig-4
Fig-9
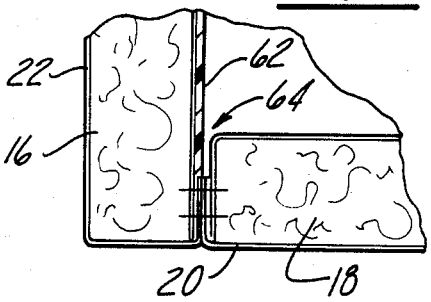

TOY BOX WITH REMOVABLE COVERING

TECHNICAL FIELD

The present invention generally relates to containers, and deals more particularly with a container suitable for use as a box for holding toys.

BACKGROUND ART

Numerous types of containers have been specially adapted in the past for use in containing toys. Because of the abuse to which toy boxes are sometimes subjected by children, previous designs have employed heavy, shock resistant structural materials, such as wood, steel and the like.

The use of sharp corners in prior art toy boxes was virtually unavoidable because of the rigid nature of materials used to construct them. Sharp corners pose a definite health hazard to small children, and particularly toddlers who are learning to walk and are apt to fall against or on the box. The mere fact that these boxes employed rigid structural materials presented a potential source of injury if a child fell and struck his head against the sidewalls of the box.

The prior art boxes possessed other disadvantages as well; they were relatively heavy and bulky and typically employed mechanical type hinges to swingably connect a lid on the box. In the case of wooden toy boxes, splinters were a constant source of concern and the mechanical hinges often resulted in pinched fingers.

Still another shortcoming of prior art toy boxes is the fact that their construction materials were often toxic or unsanitary, thus posing another form of health hazard to children and infants.

Accordingly, it is the primary object of the present invention to provide a child-safe toy box, each part of which is readily deformable and yieldable to the weight of a child falling thereon.

Another object of the invention is to provide a toy box the type mentioned above which is extremely light weight and avoids sharp edges or corners which may injure children and infants.

A still further object of the invention is to provide a toy box which avoids the use of toxic construction materials and which may be readily sanitized with minimum effort.

Another object of the invention is to provide a toy box generally similar to that described above which includes a lid swingably connected to the box by a hinge which precludes pinched fingers or bruises.

These, and further objects of the invention will be made clear or will become apparent during the course of a detailed description of the invention set out hereinbelow.

DISCLOSURE OF THE INVENTION

According to the present invention, a child-safe toy box includes a container having a base and sidewall means extending upwardly from the base to form an enclosure within which the toys may be contained. The sidewall means are defined by flexible foam material, preferably polyurethane, which is readily deformable and yieldable in response to the weight of a child imposed thereon. A form fitting cover is disposed over the base and sidewall means, thereby protectively enclosing the foam material from the surrounding environment. The cover includes an inner portion stationarily disposed over the base and sidewall means, and an outer portion removably disposed over the inner portion. The outer cover portion includes snap open seams to permit removal thereof from the container. A lid, also made of foam and having inner and outer cover portions thereon, is hingedly connected to the container by means of a cloth hinge.

BRIEF DESCRIPTION OF THE DRAWINGS

In the drawings, which form an integral part of the specification and are to be read in conjunction therewith, and in which like reference numerals are employed to designate identical parts in the various views:

FIG. 3 is a plan view of the toy box shown in FIGS. 1 and 2, the lid having been removed therefrom;

FIG. 4 is a sectional view taken along the line 4—4 in FIG. 3, the outer cover having been removed from the container;

FIG. 5 is a cross section view taken through the lid, a portion of the outer cover portion being shown immediately prior to fastening thereof to the inner cover portion;

FIG. 6 is a perspective view of the container shown in FIGS. 1 and 2, parts being broken away in section for clarity, the outer cover portion being shown partly unsnapped as during removal or installation thereof;

FIG. 7 is a sectional view taken along the line 7—7 in FIG. 6;

FIG. 8 is a fragmentary, perspective view of the opposite side of the container shown in FIG. 6; and FIG. 9 is a sectional view similar to FIG. 4 but depicting an alternate form of the invention.

BEST MODE FOR CARRYING OUT THE INVENTION

Figure 1:
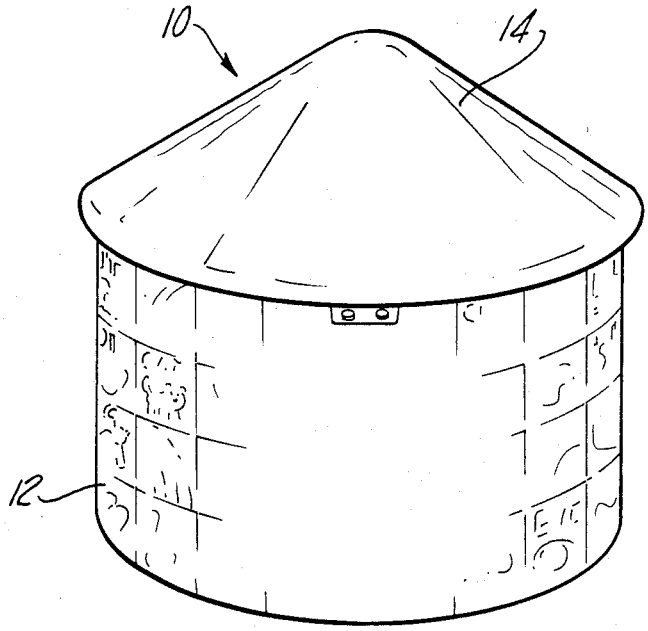
FIG. 1 is a perspective view of a toy box which forms the preferred embodiment of the present invention, the outer portion of the cover being installed thereon.
Figure 2:
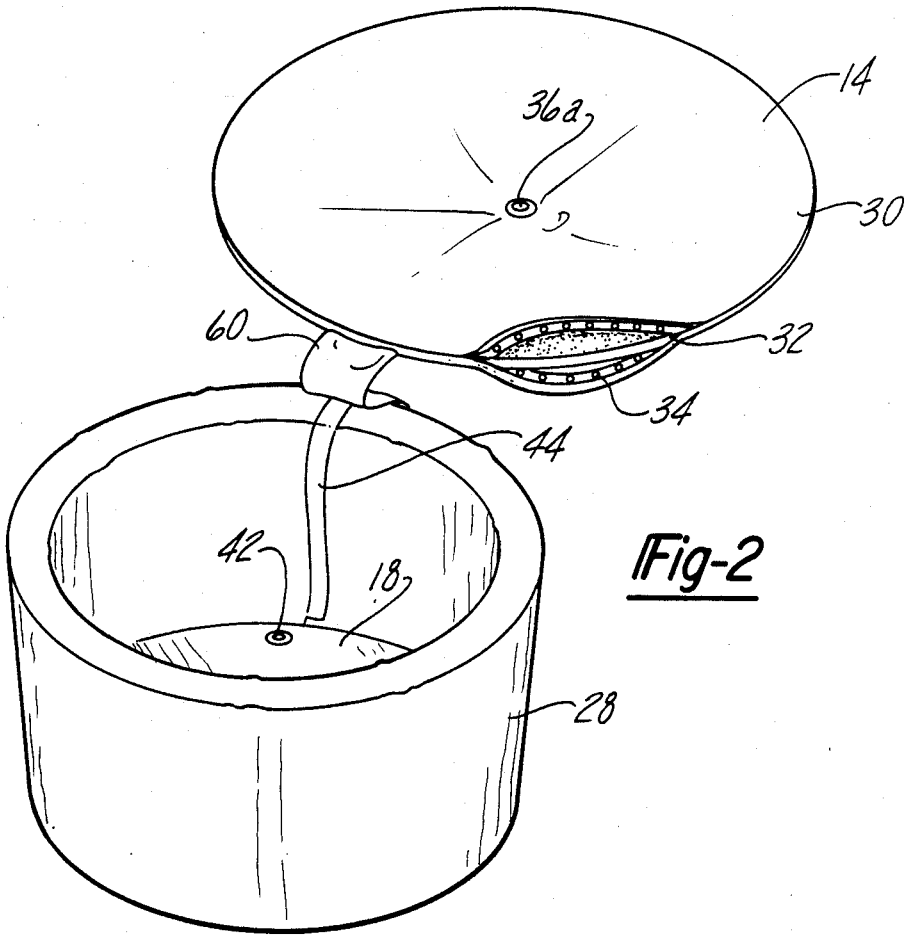
FIG. 2 is a view similar to FIG. 1 but showing the lid in an open position.

Referring first to FIGS. 1–9, the present invention is generally concerned with a toy box, broadly indicated by the numeral 10, which comprises a container 12 and lid 14. As particularly disclosed herein, the container 12 is substantially cylindrical in shape and the lid 14 is conical; however, those skilled in the art will recognize that many other alternative shapes can be employed in connection with the present invention.

Container 12 includes a circular base 18 and sidewall means extending upwardly therefrom in the nature of cylindrically shaped, circumferential sidewall 16. Sidewall 16 and base 18 are each defined by a foam material. Such foam preferably comprises polyurethane, most desirably of the ether type having a density of approximately 1.5 pounds per cubic foot. In the preferred form, such foam material also possesses the following characteristics:

Indent Load Deflection: 30 to 40 pounds
Minimum tensil strength: 10 pounds per square inch
Tear: 1.4 pounds/lineal foot
Minimum elongation: 140%

Foam of the type described above is available from Future Foam Inc. of Middleton, Wis. in sheet form and in various thicknesses. Sidewall 16 and base 18 consist of individual sheets of such foam. Foam of the type described above, particularly of the ether type, is highly desirable in the present application since it is virtually nontoxic and inflammable; consequently the health hazard to children posed thereby is minimal.

Lid 14 is also formed from a sheet or layer 38 of foam and of the type previously described. Both the sidewall 16 and foam sheet 38 may consist of one or more pieces which are joined together by means of a soft, water based (non-toxic) adhesive, which is available from Audell Inc. in Chicago, Ill.

The entire toy box 10 is protectively enclosed by an inner and outer conformal cover which will now be described in detail. The conformal cover includes an inner cover consisting of a base portion 20, sidewall portion 22 and lid portion 40. Each of the inner cover portions 20, 22 and 40 may be of any suitable sheet material such as woven cloth or the like, constructed as with sewn or bonded seams. For example, as best seen in FIG. 4 the base and sidewall portions 20 and 22 respectively of the inner cover terminate along mutual edges in a pair of overlapping seams which are sewn together at 24 using threaded stitching 26. Thus, it may be appreciated that the sidewall 16 and base 18 are joined together along the periphery of base 18 by the seam 24. The inner cover defined by portions 20, 22 and 40 are configured substantially identical to the corresponding foam which they cover and may be marginally greater in volume than such foam in order to allow the foam to bend.

The inner cover described above is intended to be permanently disposed over the toy box 10 and may function in some small degree to add structural rigidity to the foam from which the container 12 and lid 14 are formed. It is to be noted, however, that the foam from which the sidewall 16 is formed possesses sufficient compressive strength so as to be structurally self-supporting. Thus, no further framework or liner is required to maintain the upright attitude of the sidewall 16.

The conformal cover further includes, as previously mentioned, an outer cover consisting of a one piece container portion 28 and a lid portion 30 respectively covering container 12 and lid 14. The container portion 28 of the outer cover as well as the lid portion 30 thereof may be made of any suitable flexible material such as woven cloth. Preferably however, such material will be non-toxic and fire retardant to minimize health risks to children. The outer covering may have any suitable decorations or indicia sewn, printed or applied thereto. The container portion 28 of the outer cover completely envelops the base portion 20 and sidewall portion 22 of the inner cover. A plurality of snapping type interlocks 42 having male and female portions respectively secured to the floor 61 and base portion 20 are operative to secure such floor 61 to the base 18. A seam 44 defining an opening in the outer cover extends upwardly on the exterior face of the container portion 28, and over the upper edge thereof downwardly onto the interior face, within container 12. Seam 44 is defined by a pair of overlapping edges 54 and 56 (FIG. 7). A plurality of interlocking snaps 47 provide a releasable holding means for closing the seam 44 when installed on the container 12. Snaps 47 each comprise a male portion 46 and a female portion 48 respectively mounted on flexible strips 50 and 52 which are in turn sewn or bonded to the overlapping, opposed edges 52 and 54.

The lid portion 30 of the outer cover consists of a pair of flexible sheets joined around a substantial portion of their perimeter. An opening 32 is provided around a short length of the perimeter of the lid portion 30; a plurality of interlocking snaps 34, similar to snaps 47 previously described, are secured to overlapping edges of lid portion 30 so as to normally maintain the opening 32 closed. An interlocking snap consisting of a male and female portion **36*a* and 36*b* respectively secured to lid portions 30 and 40 near the apex thereof, draw the interior face of lid portion 30 upwardly against lid portion 40**.

Lid 14 is pivotally connected along an edge of container 12 by means of hinge 60. Hinge 60 comprises a web of flexible material, which may be woven cloth, having one extremity thereof sewn to lid 14, the other extremity including snaps 58 which secure the hinge to the exterior face of container 12, and more particularly to the container 28 portion of the outer cover.

If desired, in order to provide the sidewall 16 with added rigidity and/or to protect the foam in the sidewall 16, a protective liner 62 may be installed around the inner face of sidewall 16. Liner 62 preferably comprises a vertically rigid but laterally flexible plastic material which is substantially impervious to sharp objects or corners but yet which readily yields to the weight of a child bearing against the outer face of the container 12. Liner 62 may be held in place by inserting the lower edge thereof within an annular opening 64 between the sidewall 16 and base 18.

In use, the toy box 10 provides a suitable enclosure within which toys of any type may be contained. Because of the readily flexible nature of both the sidewalls 16 and lid 14, a child falling against or upon the toy box 10 is not apt to be injured since the entire box acts as a cushion to soften the impact of the child's weight. The layer of foam 38 defining the lid 14 as well as the foam sidewall 16 are sufficiently thick to prevent injury to the child from relatively sharp objects contained within the box 10. In the absence of toys, a child may be allowed to play and romp within the box 10 without fear of injury. Owing to its extreme light weight, the box 10 may be readily moved, even by an infant, from place-to-place.

In order to clean or sanitize the box 10 the user need only release the snaps 34, 42 and 47 and remove the outer cover for washing. The hinge 60 may be released from container 12 to facilitate washing or to permit a child to play with the lid 14. The cloth hinge 60, of course, poses no risk of pinched fingers and therefore is a further safety feature of the invention.

From the foregoing, it may be appreciated that the toy box described above not only provides for the reliable accomplishment of the invention but does so in a particularly simple and economical manner. It is recognized, of course, that those skilled in the art may make various modifications or additions to the preferred embodiment chosen to illustrate the invention without departing from the spirit and scope of the present contribution to the art. Accordingly, it is to be understood that the protection sought and to be afforded hereby should be deemed to extend to the subject matter claimed and all equivalents thereof fairly within the scope of the invention.

What is claimed is:

1. A container assembly suitable for use as a toy box, comprising:

a container having a base and sidewall means extending upwardly from said base to form an enclosure having an open top:

a lid installable on said container for covering said open top of said enclosure;

said sidewall means and said base each being defined by elastically deformable material readily yieldable to the weight of a child falling thereon; and flexible cover means on said sidewall means and said base for protectively enclosing each of the latter from the surrounding environment;

said cover means including a first portion enveloping said sidewall means and a second portion enveloping said base, and connecting means between said first and second portions for securing said base to said sidewall means;

said cover means further including an inner covering completely enveloping said base, said sidewall means and said lid, said inner covering being essentially fixedly disposed relative to said elastically deformable material; and an outer covering completely enveloping and removably disposed over said inner covering, said outer covering including a first and second section respectively covering said enclosure and said lid, each of first and second sections havong an opening therein through which said enclosure and said lid may be respectively drawn and means for normally closing each said opening.

2. The container assembly of claim 1, wherein said closing means includes releasable holding means on opposite sides of said openings for releasably holding said opposite sides together.

3. The container assembly of claim 2, wherein said releasable holding means includes a plurality of interlocking snap assemblies.

4. The container of claim 7, wherein said inner covering on said base includes means for releasably holding said outer covering in generaly conformity with the shape of said enclosure, and in face-to-face contact with said inner covering.

5. The container of claim 1, including:

a fabric hinge for pivotally connecting said lid and said enclosure, said hinge being fixedly attached to said removable outer covering on said enclosure and means for releasably securing said hinge on said lid.

6. A child-safe box for containing toys, comprising:

a container having a base and sidewall means extending upwardly from said base to form an enclosure within which said toys may be contained, said container having an open top;

said base and said sidewall means being defined by flexible foam material readily elastically deformable and yieldable in response to the weight of a child imposed thereon; and a form fitting cover completely enveloping said sidewall means, and said base for protectively enclosing said foam material from the surrounding environment, said cover including an inner portion completely enveloping and stationarily fixed relative to the foam material defining said enclosure, and an outer portion removably secured in conforming, super-imposed relationship over said inner portion.

7. The box of claim 6, wherein said outer portion of said cover includes:

an opening therein through which said enclosure may be drawn to separate the latter from said outer portion, and releasably holding means for closing said opening.

8. The box of claim 7, wherein said opening is defined by a pair of opposing overlapping edges of said outer portion and said releasable holding means includes a plurality of interlocking members secured between said opposing, overlapping edges.

9. The box of claim 7, wherein: said sidewall means are cylindrical in shape, and said opening in said outer portion of said cover extends from the exterior face of said sidewall means over the upper edge thereof defining said open top and onto the interior face of said sidewall means.

10. A container assembly suitable for use as a toy box, comprising:

a container having a base and sidewall means extending upwardly from said base to form an enclosure having an open top;

a lid installable on said container for covering said open top of said enclosure;

said sidewall means and said base each being defined by elastically deformable material readily yieldable to the weight of a child falling thereon;

flexible cover means on said sidewall means and said base for protectively enclosing each of the latter from the surrounding environment;

said cover means including a first portion enveloping said sidewall means and a second portion enveloping said base, said cover means including connecting means between said first and second portions for securing said base to said sidewall means;

an inner covering completely enveloping said lid of said container assembly; and an outer covering completely enveloping said inner covering, said outer covering being removably disposed on, and substantially completely enveloping said lid.

11. The container assembly of claim 10, wherein;

said inner covering is essentially fixedly disposed relative to said lid, and said outer covering envelopes said lid and includes an opening therein through which said lid may be drawn and means for normally closing said opening.

12. The container assembly of claim 11, wherein said closing means includes releasable holding means on opposite sides of said opening for releasably holding said opposite sides together

13. The container assembly of claim 12, wherein said releasable holding means includes a plurality of interlocking snap assemblies.

14. The container of claim 10, wherein said outer covering includes a woven material.

15. The container of claim 10 including:

a fabric hinge for pivotally connecting said lid and said enclosure, said hinge being fixedly attached to said removable outer covering on said lid, and means for releasable securing said hinge on said enclosure.

* * * * *

UNITED STATES PATENT AND TRADEMARK OFFICE

CERTIFICATE OF CORRECTION

PATENT NO. : 4,683,927

DATED : August 4, 1987

INVENTOR(S) : Joan B. Pyzer

It is certified that error appears in the above-identified patent and that said Letters Patent is hereby corrected as shown below: Title Page:

The date of the patent is "Aug. 4, 1898" should be --Aug. 4, 1987--.

Column 5, line 21 "havong" should be --having--.

Column 6, line 60 "releasable" should be --releasably--.

Signed and Sealed this

Eighth Day of March, 1988

*Attest:*

DONALD J. QUIGG

*Attesting Officer*

*Commissioner of Patents and Trademarks*